US006641444B2

(12) United States Patent
Hanazaki et al.

(10) Patent No.: US 6,641,444 B2
(45) Date of Patent: Nov. 4, 2003

(54) CONNECTING STRUCTURE AND CONNECTING METHOD OF TERMINAL FITTING AND ELECTRIC WIRE

(75) Inventors: Hisashi Hanazaki, Shizuoka (JP); Yasumichi Kuwayama, Shizuoka (JP); Masanori Onuma, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/987,974

(22) Filed: Nov. 16, 2001

(65) Prior Publication Data

US 2002/0061688 A1 May 23, 2002

(30) Foreign Application Priority Data

Nov. 17, 2000 (JP) ..... 2000-351830

(51) Int. Cl.[7] ..... H01R 4/10
(52) U.S. Cl. ..... 439/877; 439/882
(58) Field of Search ..... 439/887, 879, 439/865–868, 877–882; 29/863–867; 174/84 C, 74 R

(56) References Cited

U.S. PATENT DOCUMENTS

| | | | | |
|---|---|---|---|---|
| 3,522,961 A | * | 8/1970 | Cave, Sr. | 439/877 |
| 3,753,214 A | | 8/1973 | DuRocher et al. | |
| 4,239,318 A | | 12/1980 | Schwartz | |
| 4,276,523 A | | 6/1981 | Boutros et al. | |
| 5,408,743 A | * | 4/1995 | Tournier et al. | 439/877 |
| 5,496,968 A | * | 3/1996 | Katoh et al. | 174/74 R |
| 6,352,450 B1 | * | 3/2002 | Bronk et al. | 439/660 |

FOREIGN PATENT DOCUMENTS

| | | | |
|---|---|---|---|
| GB | 521536 | 5/1940 | |
| GB | 785794 | 11/1957 | |
| GB | 1298071 | 11/1972 | |
| JP | 48-32885 | 4/1973 | |
| JP | 8-96808 | 4/1996 | H01M/4/12 |
| JP | 8-96919 | 4/1996 | H01R/43/00 |

* cited by examiner

*Primary Examiner*—Jean F. Duverne
(74) *Attorney, Agent, or Firm*—Sughrue Mion, PLLC

(57) ABSTRACT

To manufacture a terminal fitting connected with an electric wire in which a core wire is covered with an insulating sheath, a cylindrical conductive member formed with a through hole is first provided. At least a part of the core wire of the electric wire is inserted into the through hole from a first end of the cylindrical member. Rotary swaging is performed onto at least the first end of the cylindrical member so as to caulk the inserted portion of the electric wire uniformly over a whole periphery thereof. Rotary swaging is performed onto at least a second end of the cylindrical member so as to compress radially to form a male type contact portion thereat.

10 Claims, 5 Drawing Sheets

CONNECTING STRUCTURE AND CONNECTING METHOD OF TERMINAL FITTING AND ELECTRIC WIRE

BACKGROUND OF THE INVENTION

The present invention relates to a connecting structure and a connecting method of a terminal fitting and an electric wire in which a terminal is caulked and connected to a core wire portion of an electric wire by swaging, while forming a male contact portion on the terminal.

FIGS. 9 and 10 show a configuration of a related connecting structure and a connecting method of a terminal fitting and an electric wire as disclosed in Japanese Utility Model Publication No. 48-32885U.

In FIG. 9, the reference numeral 41 denotes a male terminal formed of a copper alloy, the reference numeral 42 denotes a sheathed electric wire which exposes a core wire portion 43 formed of aluminum or an aluminum alloy, and the reference numeral 44 denotes a relay terminal for connecting the male terminal 41 to the core wire portion (core wire portion) 43. The relay terminal 44 is formed of the same aluminum material as that of the core wire portion 43, that is, aluminum or an aluminum alloy.

The male terminal 41 is provided with a plate-shaped contact portion 48 having such a shape as to be similar to that of an LA terminal based on JIS, that is, a ring terminal for an automobile on one of ends and an uneven shaft portion 45 on the other end. The relay terminal 44 has hole portions 46 and 47 on both front and rear sides, and the shaft portion 45 of the male terminal 41 is inserted in the hole portion 46 on the front side, and the outside part of the hole portion 46 is caulked by a proper tool (not shown) so that the male terminal 41 is connected to the relay terminal 44 as shown in FIG. 10.

Moreover, the core wire portion 43 of the electric wire 42 is inserted into the hole portion 47 on the rear side and the outside part of the hole portion 47 is caulked by a proper tool (not shown) so that the electric wire 42 is connected to the relay terminal 44. Consequently, the electric wire 42 and the male terminal 41 are electrically connected through the relay terminal 44.

Although the core wire portion 43 formed of the aluminum material has a poorer conductivity than that of the core wire portion formed of copper, it is light-weighted and inexpensive. In addition, if a diameter thereof is increased, a corona characteristic can be improved. Therefore, the core wire portion 43 can meet a requirement for a multi-source and a large current and is suitable for an electric car, for example.

In the structure shown in FIG. 10, the male terminal 41 formed of copper having a greater elastic modulus than that of the relay terminal 44 formed of aluminum is used. Consequently, the caulked shaft portion 45 comes in close contact with the inner periphery of the hole portion 46 (FIG. 9) so that an excellent electrical contact property can be obtained. Moreover, the relay terminal 44 and the core wire portion 43 which are formed of the same material are caulked so that an connecting portion can be prevented from being loosened due to a difference in the elastic modulus.

As a matter of course, the materials of the relay terminal 44 and the core wire portion 43 having the configuration described above are not limited to aluminum but copper or a copper alloy can also be used for formation.

In the related connecting structure and connecting method of a terminal and an electric wire, however, the relay terminal 44 is used so that the number of parts is increased. Consequently, there is a problem in that a cost is increased. Moreover, the male terminal 41 and the relay terminal 44 are caulked and connected while the relay terminal 44 and the electric wire 42 are caulked and connected so that a time and labor to be taken is doubled. Thus, there is a problem in that a connecting workability is poor.

Moreover, there are two front and rear connecting portions, that is, the connection of the male terminal 41 to the relay terminal 44 and the connection of the relay terminal 44 to the electric wire 42. Therefore, a contact resistance might be increased so that a conduction performance might be deteriorated.

When the caulking operation is performed, a clearance is easily formed between the shaft portion 45 and the relay terminal 44 and between the relay terminal 44 and the core wire portion 43, and a clearance is easily formed between wires constituting the core wire portion 43. Consequently, there is a probability that the conduction performance might be deteriorated.

In particular, the core wire portion 43 and the relay terminal 44 which are formed of the aluminum material are used. Therefore, in the case in which the clearance is formed, the inner face of the hole portion 46 of the relay terminal 44 connecting the male terminal 41, the face of the core wire portion 43 and the inner face of the hole portion 47 of the relay terminal 44 are oxidized with the passage of time so that an oxide film is formed. Consequently, the contact resistance of the male terminal 41 and the core wire portion 43 might be increased so that the conduction performance is deteriorated.

SUMMARY OF THE INVENTION

It is therefore an object of the present invention to provide a connecting structure and a connecting method of a terminal and an electric wire, wherein a male terminal and a core wire portion of an electric wire can be easily connected in a short time at a low cost with a high workability; the male terminal and the core wire portion of the electric wire can be reliably connected without a clearance to enhance a conduction performance; and the problem of an oxide film can be eliminated to attain the object easily and reliably even if a terminal and a core wire portion are formed of an aluminum material.

In order to achieve the above object, according to the present invention, there is provided a connecting structure, comprising:

an electric wire in which a core wire is covered with an insulation sheath; and a cylindrical terminal fitting, integrally formed with a male type contact portion at a front end portion thereof by rotary swaging, the terminal fitting including a connecting portion which is electrically connected to the electric wire such that at least a part of the core wire is caulked uniformly over a whole periphery thereof by rotary swaging.

According to the present invention, there is also provided a method of manufacturing a terminal fitting electrically connected with an electric wire in which a core wire is covered with an insulating sheath, comprising the steps of:

providing a cylindrical conductive member formed with a through hole;

inserting at least a part of the core wire of the electric wire into the through hole from a first end of the cylindrical member;

performing rotary swaging onto at least the first end of the cylindrical member so as to caulk the inserted portion of the electric wire uniformly over a whole periphery thereof; and performing rotary swaging onto at least a second end of the cylindrical member so as to compress radially to form a male type contact portion thereat.

In the above configurations, since the connecting portion of the terminal fitting is uniformly compressed and plastically deformed over the whole periphery by the rotary swaging (the whole peripheral face of the connecting portion is uniformly caulked), the inner face of the connecting portion comes in close contact with the core wire of the electric wire without a clearance. Further, since the core wire is strongly compressed in a central direction over the whole periphery by the rotary swaging, a clearance between a plurality of strand wires constituting the core wire is eliminated so that the conduction resistance of the electric wire and the terminal fitting can be reduced and the conduction performance can be enhanced.

Moreover, the male type contact portion is formed simultaneously or almost simultaneously at the same step as the formation of the connecting portion by the rotary swaging. Consequently, a time required for manufacturing the terminal can be shortened and the cost of the terminal can be reduced. Furthermore, since another member such as a relay terminal is not required, the cost of parts can be reduced and the man-hour of the electric wire connection can be reduced. Moreover, since the alignment of centers of the contact portion and the connecting portion is automatically completed, the adhesion of a waterproof rubber plug to be inserted and fixed into the outer periphery of the electric wire and the internal wall face of the terminal housing chamber of a connector housing can be enhanced, for example. Furthermore, the section of the male contact portion is formed to be completely circular (completely round) so that the contact property of a mating female terminal and the contact portion can be enhanced.

Preferably, the terminal fitting is formed with an annular flange portion on an outer periphery thereof.

In this configuration, a portion which is not subjected to the rotary swaging is provided in a part of the terminal fitting. Consequently, the annular flange portion can be formed easily at a low cost. The flange portion is useful for engaging or fixing the terminal to a connector housing, for example.

Preferably, at least one of the terminal fitting and the core wire is made of an aluminum material.

In this configuration, force required for plastically processing the contact portion is not greater as compared with a copper material and the processing can be carried out easily and rapidly. Even in such a case, since the inner face of the connecting portion of the terminal fitting comes in close contact with the core wire of the electric wire without clearance, an oxide film can be prevented from being formed on the inner face of the terminal fitting or the core wire with the passage of time. Thus, an excellent conduction performance can be maintained. Furthermore, the core wire eats into the inner peripheral face of the terminal by the rotary swaging so that an initial oxide film can be removed by friction and an excellent conduction performance can be obtained.

Preferably, the rotary swaging for caulking and the rotary swaging for forming the contact portion are performed by a first die having a first curvature for caulking and a second die having a second curvature for the contact portion formation.

In this configuration, the connecting portion and the contact portion can be efficiently compressed in a short time and the connection of the electric wire and the formation of the male terminal can be efficiently carried out.

Here, it is preferable that the manufacturing method further comprises the step of performing rotary swaging for forming a slanted portion which connects the caulked portion of the cylindrical member and the male type contact portion, by using a third die for forming the slanted portion.

In this configuration, the slanted portion between the contact portion and the connecting portion is compressed to be well tapered so that a commercial value can be enhanced. In addition, the bending strength of the contact portion can be increased so that deformation can be prevented from being caused by an interference during insertion to a female terminal on the other side.

Alternatively, the rotary swaging for caulking and the rotary swaging for forming the contact portion are performed by a single die having a first curvature portion for caulking and a second curvature portion for the contact portion formation.

In this configuration, the step of exchanging the dies is not required so that a processing work efficiency can be enhanced still more.

Here, it is preferable that the manufacturing method further comprises the step of performing rotary swaging for forming a slanted portion which connects the caulked portion of the cylindrical member and the male type contact portion. The single die has a portion for forming the slanted portion.

In this configuration, the die for processing the contact portion and for processing the connecting portion serves as the slanted portion of the terminal fitting. Consequently, the step of exchanging the dies is not required so that the processing work efficiency can be enhanced still more.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1:
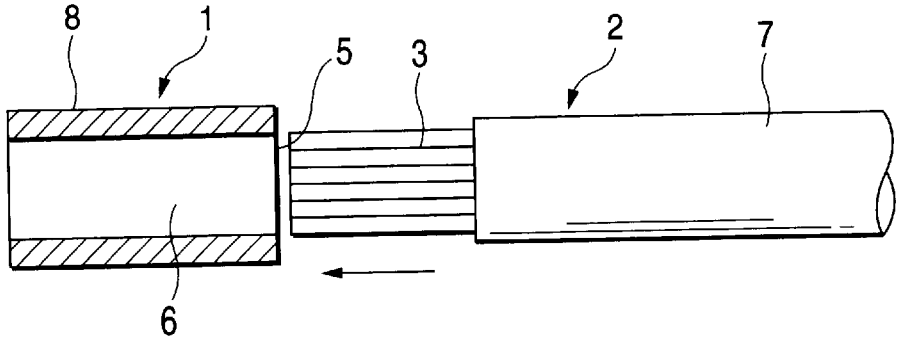
FIG. 1 is a partial section side view of a connecting structure and a connecting method according to one embodiment of the invention, showing a state before a terminal member is set onto an electric wire.
Figure 2:
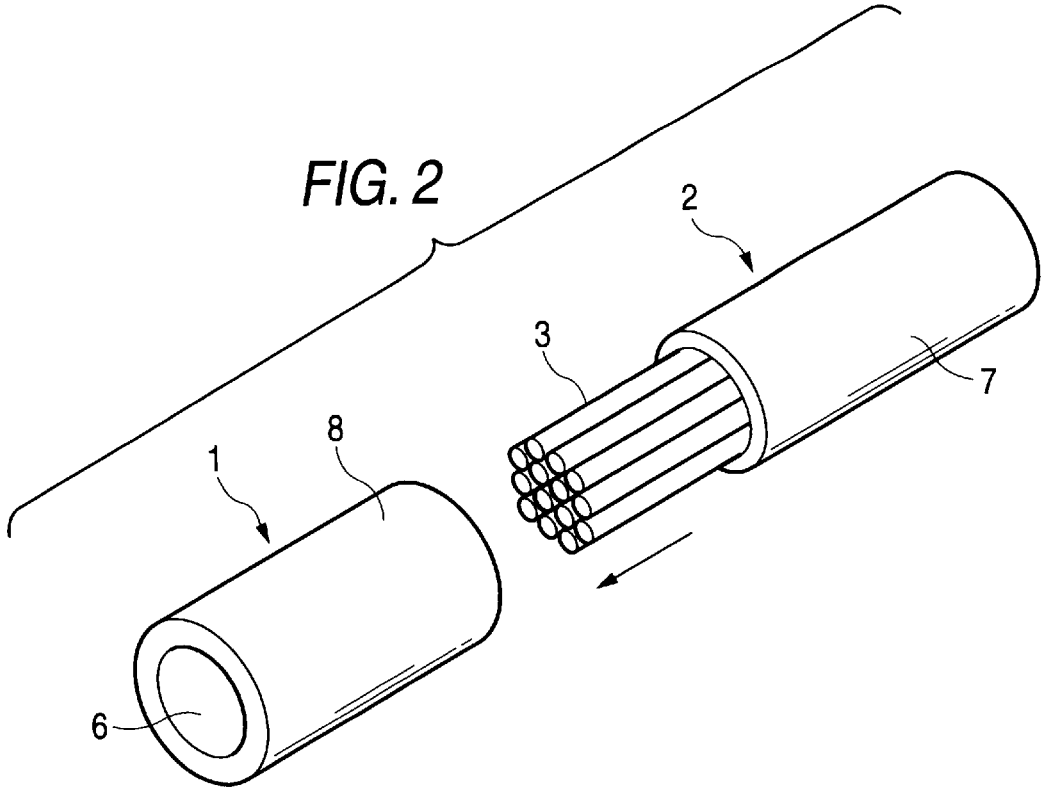
FIG. 2 is a perspective view showing the state shown in FIG. 1.

Preferred embodiments of the invention will be described below in detail with reference to the accompanying drawings.

FIGS. 1 to 7 show one embodiment of a connecting structure and a connecting method of a terminal fitting and an electric wire according to the invention.

In these drawings, the reference numeral 2 denotes a sheathed electric wire having a core wire portion 3 formed of aluminum or an aluminum alloy (these are generally referred to as aluminum materials), and the reference numeral 1 denotes a cylindrical terminal member formed of an aluminum material.

The connecting structure and connecting method is characterized in that the cylindrical terminal member 1 formed of a conductive metal is uniformly caulked over the whole periphery to connect the core wire portion 3 of the electric wire 2 and to form a male contact portion 4 integrally with the terminal member 1.

The terminal member 1 is formed with a through hole 6 extending in a longitudinal direction thereof (the longitudinal direction of an electric wire), and the through hole 6 forms openings 5 having the same diameter on front and rear ends, from one of which the core wire portion 3 is inserted. The inner diameter of the through hole 6 is greater than the outer diameter of the core wire portion 3 of the electric wire 2. Since a rotary swaging described later is performed, a single size of the terminal member 1 having such a through hole 6 can be adapted to a core wire portion having any outer diameter smaller than the inner diameter of the through hole 6.

The length of the through hole 6, that is, the whole length of the terminal member 1 is set to be greater than the exposure length of the core wire portion 3. For example, it is preferable that the whole length of the terminal member 1 should be set to a double of the exposure length of the core wire portion 3 or more. The core wire portion 3 is exposed by peeling a soft insulating resin coating 7 of the electric wire 2 to have a predetermined length by an automatic peeling machine (not shown), for example.

Figure 3:
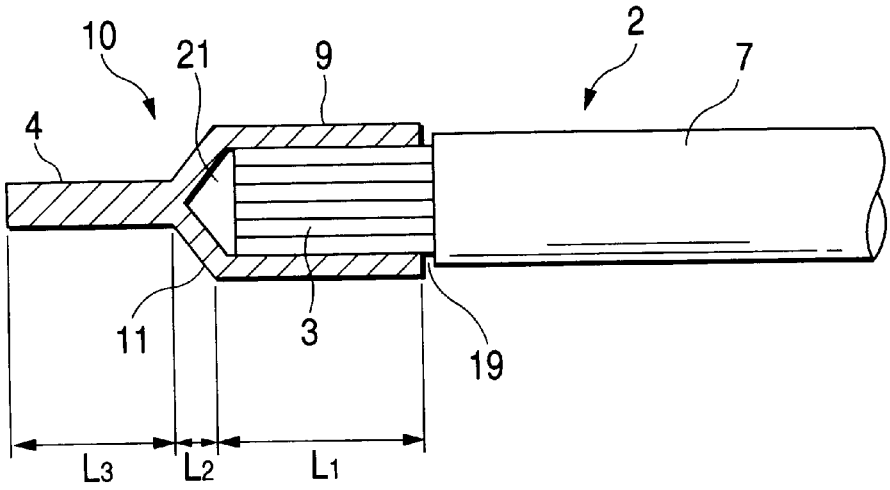
FIG. 3 is a partial section side view of the terminal member and the electric wire, showing a state after a rotary swaging is performed.
Figure 4:
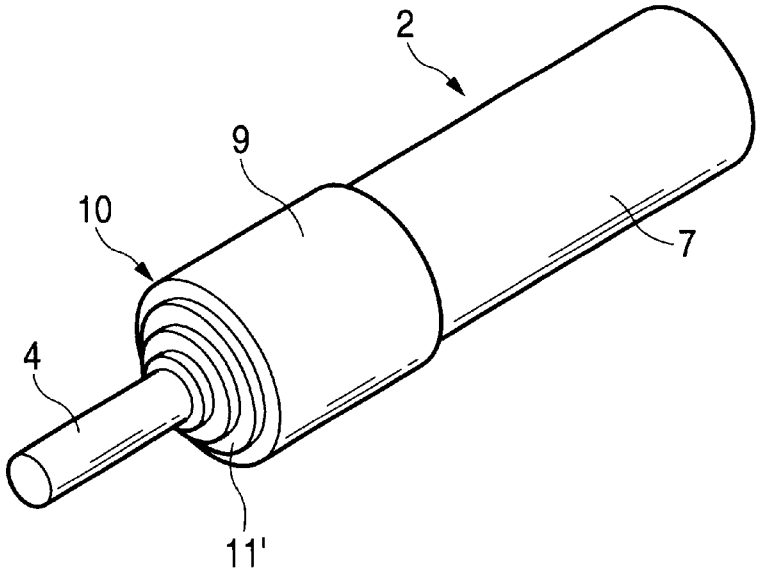
FIG. 4 is a perspective view showing the state shown in FIG. 3.

With the core wire portion 3 inserted in the through hole 6, the rear part of a peripheral wall 8 of the terminal member 1 (a portion inserting the core wire portion 3) is uniformly caulked over the whole periphery as shown in FIGS. 3 and 4 by a rotary swaging machine which will be described later and is thereby changed into a cylindrical connecting portion 9 and the front part of the peripheral wall 8 of the terminal member 1 is compressed to have the shape of a columnar pin by the same rotary swaging machine and is thereby changed into a male contact portion 4. Thus, the cylindrical terminal member 1 is changed into a terminal 10 having the male contact portion 4 by the swaging.

A part of the terminal member 1 to be the connecting portion 9 and a part of the terminal member 1 to be the male contact portion 4 may not have the same length. The former may be shorter while the latter may be longer. Alternatively, in the case in which the male contact portion 4 is to be formed longer, it is also possible to set the former is made longer while the latter is made shorter. The male contact portion 4 is formed to have a smaller diameter than that of the core wire portion 3.

Tapered or stepped intermediate portions 11 and 11' are formed between the male contact portion 4 and the cylindrical connecting portion 9. FIG. 3 shows the tapered intermediate portion 11 and FIG. 4 shows the stepped intermediate portion 11'. As shown in FIG. 3, the inner part of the intermediate portion 11 forms a hollow portion 21 and the leading end of the core wire portion 3 is opposed to the slanted inner face of the intermediate portion 11.

Figure 5:
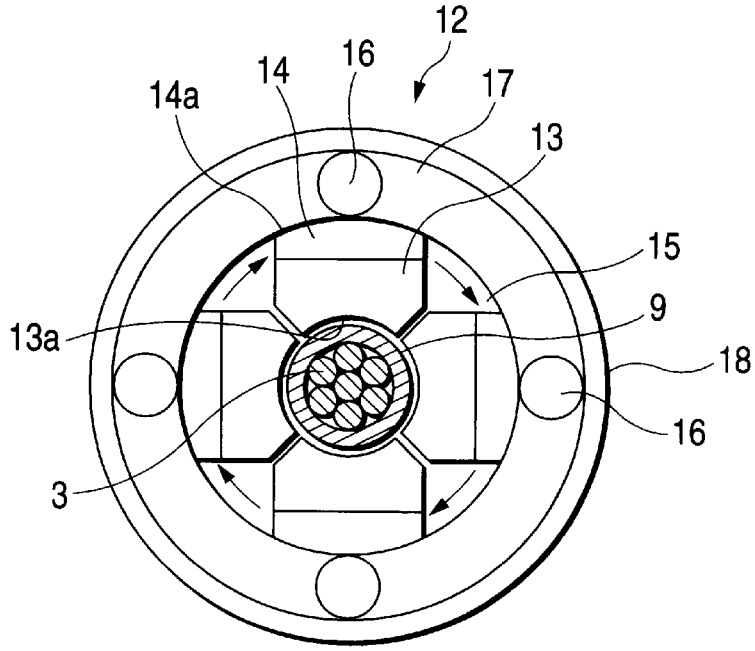
FIG. 5 is a front view showing a state in which a connecting portion of a terminal member is swaged.
Figure 6:
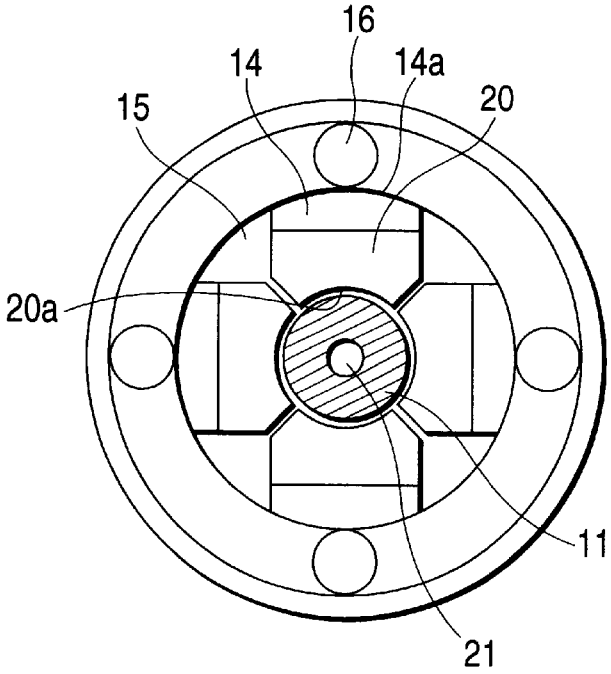
FIG. 6 is a front view showing a state in which an intermediate portion of the terminal member is swaged.
Figure 7:
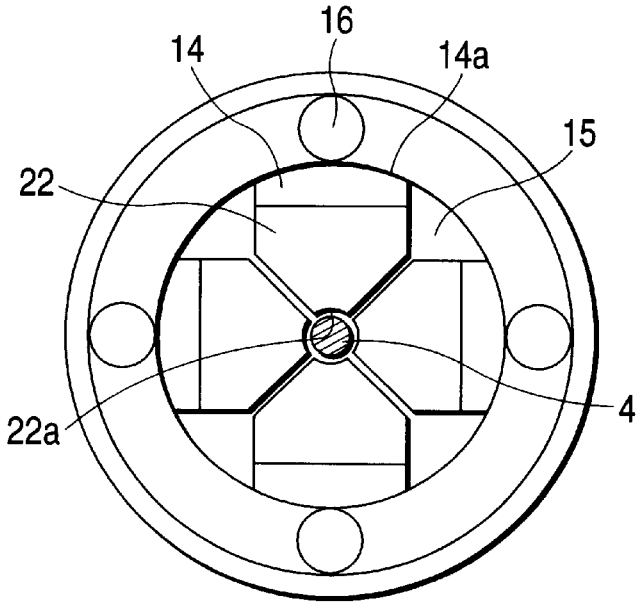
FIG. 7 is a front view showing a state in which a male contact portion of the terminal member is swaged.

FIGS. 5 to 7 show a method of forming the male terminal 10 (FIGS. 3 and 4) by uniformly caulking the terminal member 1 (FIGS. 1 and 2) over the whole periphery by the rotary swaging, tightly caulking and connecting the core wire portion 3 by the same stress over the whole periphery and forming the male contact portion 4 on the terminal member 1. FIGS. 5 to 7 show a processing portion which is the main part of a rotary swaging machine 12.

As shown in FIG. 5, the cylindrical peripheral wall 8 of the terminal member 1 (FIGS. 1 and 2) to be the portion connected with the core wire portion 3 of the electric wire 2 is compressed, plastically deformed and caulked while being beaten toward the center of the electric wire 2 through a plurality of (four in the embodiment) dies 13 of the rotary swaging machine 12 and the core wire portion 3 is caused to strongly come in close contact with the inner face of the peripheral wall 8, thereby forming the connecting portion 9.

In this case, each die 13 is rotated by a spindle 15 in the circumferential direction of the electric wire as shown in an arrow and a cam face 14*a* on the outer periphery of a hammer 14 formed integrally with the die 13 slides along a guide roller 16. Incidentally, the die 13 is strongly pressed (beaten) against the peripheral wall 8, that is, the outer peripheral face of the connecting portion 9 toward the center of the electric wire.

The spindle 15 is driven by a motor which is not shown, the cam face 14*a* of the hammer 14 slips off from the guide roller 16 with the rotation of the spindle 15 and the die 13 is opened (slides) outward integrally with the hammer 14 by centrifugal force, and subsequently, the cam face 14*a* of the hammer 14 comes in sliding contact with the adjacent guide roller 16 and the die 13 slides in a closing direction again toward the center of the electric wire 2 so that the peripheral wall 8 of the terminal member 1 is compressed and deformed. The operation is repeatedly carried out so that a plurality of dies 13 are rotated to plastically deform the cylindrical peripheral wall 8 of the terminal member 1 in a direction of compression. Consequently, the cylindrical connecting portion 9 is formed.

It is preferable that the cam face 14*a* of the hammer 14 should have the direction of curvature of a top portion thereof reverse to that of a bottom portion in place of a circular arc face shown in FIG. 5. Each die 13 has an arcuate inner face 13*a* having a curvature corresponding to the caulked outer diameter of the connecting portion 9. The arcuate inner face 13*a* of each die 13 is matched to constitute a circular internal peripheral face. In FIG. 5, for convenience, a clearance is drawn between the die 13 and the cylindrical connecting portion 9 for the convenience of explanation. Actually, the inner face 13*a* of the die 13 is pressed in contact with the outer peripheral face of the connecting portion 9 with the cam face 14*a* of the hammer 14 in contact with the guide roller 16. The same state is shown in FIGS. 6 and 7 which will be described below. The die 13 and the hammer 14 are slidable in a radial direction of the electric wire 2 along the spindle 15.

The arcuate inner face 13*a* of each die 13 beats and compresses the outer peripheral face of the peripheral wall 8 of the terminal member 1. Therefore, it is also possible to set the curvature of the arcuate inner face 13*a* of the die 13 to be larger than the caulking outer diameter of the connecting portion 9 of a final product.

The die 13 and the hammer 14 are fixed to each other with a bolt, for example, and can be separated from each other. It is also possible to use the hammer 14 in common, thereby changing only the die 13 to another one have a different curvature. Alternatively, it is also possible to form the die 13 integrally with the hammer 14, thereby collectively changing them to another one have different curvature. Moreover, the swaging processing in FIG. 5 may be first carried out over the whole length of the terminal member 1 and then the processing shown in FIGS. 6 and 7 may be carried out.

The guide roller 16 is rotatably supported pivotally on a main body 17 of the swaging machine 12, for example, and the inner part of the guide roller 16 is provided in contact with the cam face 14*a* of the hammer 14 and the outer part of the guide roller 16 is provided in contact with the inner peripheral face of an outer ring 18. Each guide roller 16 is positioned at an angular interval of 90 degrees corresponding to each hammer 14. The number of the guide roller 16 and the angular intervals thereof are not limited to the above, if the angular intervals are made constant.

The cylindrical connecting portion 9 of the terminal 10 in FIG. 3 is uniformly caulked over the whole periphery within a range of a length $L_1$ by the die 13 in FIG. 5. In this case, the peripheral wall 8 of the terminal member 1 in FIG. 1 is reduced in a diameter and a thickness, and at the same time, is extended to some degree in a longitudinal direction. The core wire portion 3 is compressed in a radial direction toward a core and is strongly pressed in contact with the inner peripheral face of the cylindrical connecting portion 9 so that each strand wire on the outer peripheral side of the core wire portion 3 eats into the inner peripheral face of the connecting portion 9 and tightly comes in contact without any clearance inside the connecting portion 9. Consequently, it is possible to prevent an oxide film from being formed between the core wire portion 3 formed of an aluminum material and the terminal 10 formed of an aluminum material (a completely processed product is referred to as a terminal).

Even if the oxide film initially sticks to the face of the core wire portion 3 or the inner peripheral face of the terminal member 1, each strand wire on the outer peripheral side of the core wire portion 3 eats into the inner peripheral face of the terminal member 1 so that the oxide film is peeled by friction and the base materials of the terminal 10 and the electric wire 2 come in contact with each other at a very low conduction resistance. Therefore, the reliability of the electrical connection can be enhanced.

While a slight gap 19 is provided between the rear end of the cylindrical connecting portion 9 of the terminal 10 and the insulating coating 7 of the electric wire 2 as shown in FIG. 3, it is also possible to caulk the rear end side of the connecting portion 9 together with the insulating coating 7 to waterproof or to prevent the oxidation of the core wire portion 3.

The invention is characterized in that the male contact portion 4 is formed on the terminal member 1 by the swaging after, before or at the same time that the core wire portion 3 is caulked, thereby forming the male terminal 10.

FIG. 6 shows a state in which the tapered (almost conical) or stepped intermediate portions 11 and 11' within a range of a length $L_2$ of the intermediate portion of the terminal 10 in FIG. 3 are subjected to the swaging.

Each die 20 including a tapered inner face 20*a* (having an arcuate longitudinal section) is used, and is rotated with the rotation of the spindle 15 in the same manner as in FIG. 5 to advance or retreat in the radial direction of the electric wire by the sliding contact of the cam face 14*a* of the hammer 14 with the guide roller 16, and the intermediate portion of the terminal member 1 is beaten to be compressed and plastically deformed into a tapered shape. In the case in which the diameter is first reduced over the whole length of the terminal member 1 at the swaging process shown in FIG. 5, the swaging process in FIG. 6 can be carried out more easily. In FIG. 6, a conical space 21 is present on the inside of the intermediate portion of the terminal 10. Since the intermediate portion of the terminal member 1 is to be beaten and deformed by each die 20, the diameter of the tapered inner face (slanted portion) 20*a* of the die 20 may be greater than the caulked outer diameter of the finished intermediate portion 11.

In the case in which the intermediate portion 11' of the terminal 10 is to be processed stepwise as shown in FIG. 4, for example, the intermediate portion of the terminal member 1 is compressed and deformed by the rotating die 20 having the inner face 20*a* which is not tapered but arcuate, and at the same time, the terminal member 1 is gradually moved in an axial direction thereof. Consequently, the stepped intermediate portion 11' having a high rigidity can be obtained. Also in this case, the intermediate portion of the terminal member 1 is beaten and deformed by each die 20. Therefore, the diameter of the arcuate inner face 20*a* of each die 20 may be larger than the caulked outer diameter of the finished intermediate portion 11'. The diameter of the intermediate portion 11' is reduced as closing to the male contact portion 4.

It is also possible to process the terminal member 1 by using two kinds of dies 13 and 22 having different diameters in FIG. 5 and FIG. 7 which will be described below in place of the die 20 used in the swaging shown in FIG. 6. In this case, the intermediate portion 11 has such an optional configuration that the cylindrical connecting portion 9 and the male contact portion 4 are directly linked with each other.

FIG. 7 shows a state in which the pin-shaped male contact portion 4 is formed in the front part of the terminal member 1 by using four dies 22 including arcuate inner peripheral faces 22*a* having small diameters. The swaging processing is carried out within a range of a length $L_3$ of the terminal 10 in FIG. 3.

The curvature of the arcuate inner faces 22*a* of the dies 22 are configured such that a circle having a diameter equal to or greater than the outer diameter of the finished male contact portion 4 is formed when all the dies 22 are brought contact with each other. It is apparent that the arcuate inner face 22*a* of each die 22 is pressed in contact with the outer peripheral face of the male contact portion 4 when the cam face 14*a* of each hammer 14 comes in contact with the guide roller 16.

When the die 22 is rotated with the rotation of the spindle 15 and the cam face 14*a* of the hammer 14 comes in sliding contact with the guide roller 16, the arcuate inner face 22*a* of the die 22 beats, compresses and plastically deforms the front part of the peripheral wall 8 of the terminal member 1 in the radial direction thereof. In the case in which the terminal member 1 is compressed and deformed over the whole length in the swaging process shown in FIG. 5, the male contact portion 4 can be swaged more easily. When the cam face 14*a* of the hammer 14 slips off from the guide roller 16, the die 22 is opened outward and the diameter of the front part of the peripheral wall 8 of the terminal member 1 is gradually reduced by repeatedly opening and closing the die 22 so that the pin-shaped male contact portion 4 can be obtained.

The center of the male contact portion 4 is aligned with the center of the cylindrical connecting portion 9 while being made concentrically. The outer diameter of the male contact portion 4 is entirely uniform in a longitudinal direction. It is also possible to form a taper guide face (see FIG. 8) on the leading end of the male contact portion 4 by the same method as the taper processing of the intermediate portion 11. Since the aluminum material is used for the material of the terminal member 1, force required for plastically processing the male contact portion 4 is not greater as compared with a copper material and the processing can be carried out easily and rapidly. As a matter of course, it is also possible to form the terminal member 1 of the copper material (copper or a copper alloy) and to process the terminal member 1 by the swaging in the same manner as shown in FIGS. 5 to 7.

In the case in which the outer diameter of the male contact portion 4 is much smaller than the outer diameter of the initial terminal member 1, it is also possible to reduce the diameter of the male contact portion 4 by sequentially using a plurality of dies 22 having two or more curvatures of the arcuate inner face 22*a*.

In the above method, either the swaging process shown in FIG. 5 or the swaging process shown in FIG. 7 may be first performed before the swaging process shown in FIG. 6 is performed. Here, the dies 13, 20 and 22 may be exchanged for each step by using one swaging machine 12 or a plurality of swaging machines 12 including different dies 13, 20 and 22 may be used.

Using a single die in which the dies 13, 20 and 22 in FIGS. 5 to 7 are integrated, the caulking of the whole periphery of the cylindrical connecting portion 9, the processing of the intermediate portion 11 and the formation of the male contact portion 4 can also be carried out at the same time. In this case, the shape of the single die is integrally constituted by a front part including an inner peripheral face having a small curvature corresponding to the male contact portion 4, an intermediate portion having a tapered inner peripheral face (slanted portion) corresponding to the intermediate portion 11, and a rear part including an inner peripheral face having a large curvature corresponding to the connecting portion 9. First of all, the male contact portion 4 having a small diameter is compressed and the intermediate portion 11 is then compressed, and at the same time or finally, the connecting portion 9 is compressed.

Figure 8:
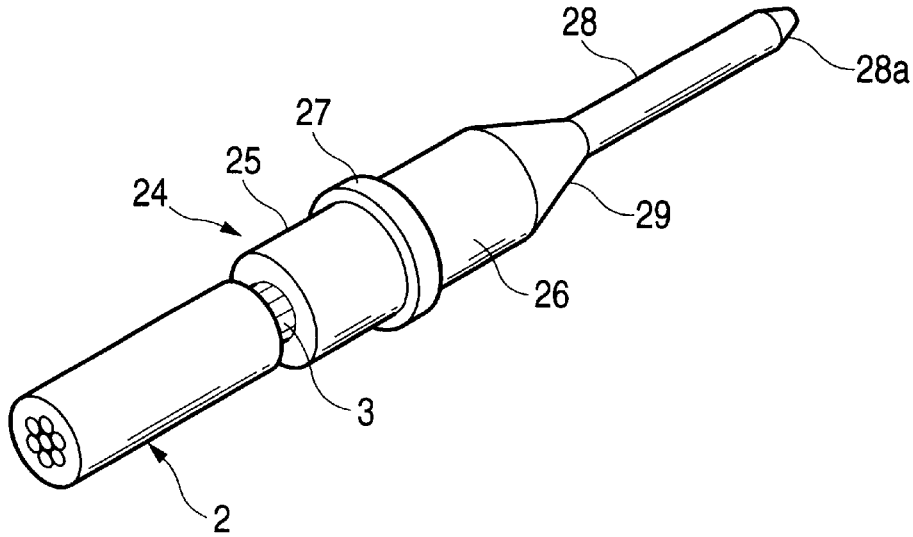
FIG. 8 is a perspective view showing a connecting structure and a connecting method of a terminal and an electric wire according to another embodiment of the invention.
Figure 9:
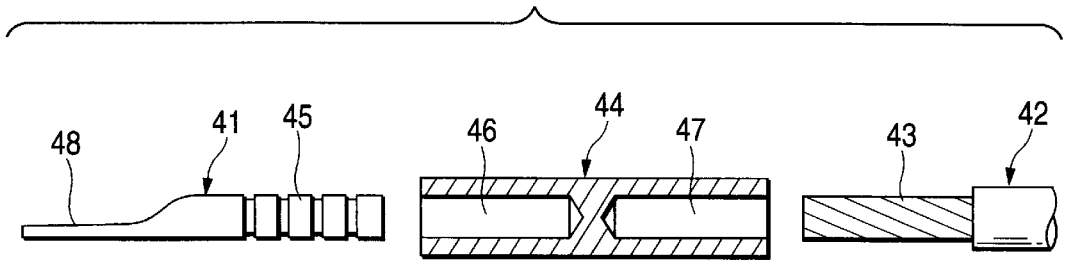
FIG. 9 is a partial section side view showing a related connecting structure and a connecting method of a terminal and an electric wire, showing a state before the terminal and the electric wire are connected.
Figure 10:
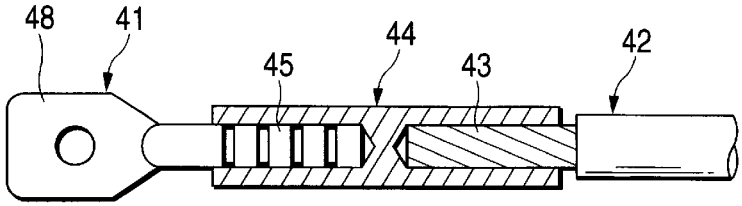
FIG. 10 is a partial section side view showing the related connecting structure and the connecting method, showing the state in which the terminal and the electric wire are connected.

FIG. 8 shows another embodiment of the present invention. A terminal 24 is also formed by swaging a terminal member 1 (FIG. 1) made of an aluminum material and connected to a core wire portion 3 made of an aluminum material in an electric wire 2.

The terminal 24 has an annular flange portion 27 in the middle of cylindrical peripheral walls 25 and 26 and has a pin-shaped male contact portion 28 on a front end of the peripheral wall 26. The peripheral wall 26 on the front side is swaged simultaneously with or separately from the peripheral wall (connecting portion) 25 on the rear side so that the inside thereof is hollow or solid. The intermediate flange portion 27 is not swaged and has the same diameter as the outer diameter of the peripheral wall 8 of the initial terminal member 1.

For example, when the terminal 24 is inserted in a connector housing (not shown) formed of an insulating resin, the flange portion 27 is engaged with a flexible terminal engagement lance in a terminal chamber so that the terminal 24 can be prevented from slipping off rearward. Alternatively, the flange portion 27 is caused to abut on a partition wall (not shown) for partitioning a connector fitting chamber and the terminal housing chamber in the connector housing, thereby defining the protrusion length of the male contact portion 28. The peripheral wall 26 on the front side is inserted or pressed into the hole portion (not shown) of the partition wall.

The male contact portion 28 is swaged by the same method as that in FIG. 7. The diameter of the terminal member 1 having the initial shape is reduced to be smaller by one step, thereby forming the peripheral wall 26 on the front side. Furthermore, the front side of the peripheral wall 26 on the front side is swaged to be the male contact portion 28. Thus, the male contact portion 28 is smoothly processed to have an accurate outer diameter and length.

The leading end of the male contact portion 28 is processed to be tapered by a die (not shown) during the processing of the contact portion 28, and is thus changed into an insertion guide face 28*a* for a mating female terminal (not shown). Moreover, an intermediate slanted portion 29 between the male contact portion 28 and the peripheral wall 26 on the front side is swaged like a taper by the same method as that in FIG. 6.

The core wire portion 3 of the electric wire 2 is uniformly caulked and connected onto the peripheral wall 25 on the rear side of the terminal 24, that is, the connecting portion over the whole periphery by the swaging. The method of caulking and connecting the core wire portion 3 is the same as that in FIG. 5. The core wire portion 3 comes in close contact with the inside of the connecting portion 25 without clearance, and the strand wires of the core wire portion 3 come in close contact with each other without clearance. The strand wire on the outer peripheral side of the core wire portion 3 eats into the inner face of the connecting portion 25. Also in the combination of the core wire portion 3 formed of an aluminum material and the terminal 24 formed of an aluminum material, consequently, an oxide film is prevented from being formed on the surface of the aluminum material or is removed so that a conduction resistance can be reduced to enhance an electric contact performance.

The front and rear peripheral walls 25 and 26, the male contact portion 28 and the intermediate slanted portion 29 may be processed by using the separate dies 13, 20 and 22 as shown in FIGS. 5 to 7, or the front and rear peripheral walls 25 and 26, the male contact portion 28 and the intermediate slanted portion 29 may be simultaneously processed by using a single die integrating the dies 13, 20 and 22 having the configurations shown in FIGS. 5 to 7 (grooves are formed in the die so as to correspond to the flange portion 27).

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connecting structure, comprising:

an electric wire in which a core wire is covered with an insulation sheath; and a cylindrical terminal fitting, integrally formed with a male type contact portion at a front end portion thereof by rotary swaging, the terminal fitting including a connecting portion which is electrically connected to the electric wire such that at least a part of the core wire is caulked uniformly over a whole periphery thereof by rotary swaging, wherein said rotary swaging compresses said cylindrical fitting radially inwardly to form said male type contact portion and to form said connection of the connecting portion with the electric wire.

2. The connecting structure as set forth in claim 1, wherein the terminal fitting is formed with an annular flange portion on an outer periphery thereof.

3. The connecting structure as set forth in claim 1, wherein at least one of the terminal fitting and the core wire is made of an aluminum material.

4. A method of manufacturing a terminal fitting electrically connected with an electric wire in which a core wire is covered with an insulating sheath, comprising the steps of:

providing a cylindrical conductive member formed with a through hole;

inserting at least a part of the core wire of the electric wire into the through hole from a first end of the cylindrical member;

performing rotary swaging onto at least the first end of the cylindrical member so as to caulk the inserted portion of the electric wire uniformly over a whole periphery thereof; and performing rotary swaging onto at least a second end of the cylindrical member so as to compress radially to form a male type contact portion thereat.

5. The manufacturing method as set forth in claim 4, wherein the rotary swaging for caulking and the rotary swaging for forming the contact portion are performed by a first die having a first curvature for caulking and a second die having a second curvature for the contact portion formation.

6. The manufacturing method as set forth in claim 4, wherein the rotary swaging for caulking and the rotary swaging for forming the contact portion are performed by a single die having a first curvature portion for caulking and a second curvature portion for the contact portion formation.

7. The manufacturing method as set forth in claim 5, further comprising the step of performing rotary swaging for forming a slanted portion which connects the caulked portion of the cylindrical member and the male type contact portion, by using a third die for forming the slanted portion.

8. The manufacturing method as set forth in claim 6, further comprising the step of performing rotary swaging for forming a slanted portion which connects the caulked portion of the cylindrical member and the male type contact portion, wherein the single die has a portion for forming the slanted portion.

9. The manufacturing method as set forth in claim 4, wherein at least one of the cylindrical member and the core wire is made of an aluminum material.

10. The method of claim 4, wherein said steps of performing rotary swaging include compressing said cylindrical conductive member radially inwardly.

* * * * *